US010264349B2

(12) United States Patent
Chen

(10) Patent No.: US 10,264,349 B2
(45) Date of Patent: Apr. 16, 2019

(54) COMBINED-TYPE PHASE PLUG, AND COMPRESSION DRIVER AND SPEAKER USING SAME

(71) Applicant: Premium Loudspeakers (Hui Zhou) Co., Ltd., Huizhou, Guangdong Province (CN)

(72) Inventor: Zhi Chen, Huizhou (CN)

(73) Assignee: PREMIUM LOUDSPEAKERS (HUI ZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/025,245

(22) Filed: Jul. 2, 2018

(65) Prior Publication Data

US 2019/0028801 A1 Jan. 24, 2019

(30) Foreign Application Priority Data

Jul. 21, 2017 (CN) ..... 2017 1 0601376

(51) Int. Cl.
*H04R 1/30* (2006.01)
*H04R 9/06* (2006.01)
*H04R 1/28* (2006.01)

(52) U.S. Cl.
CPC ..... *H04R 1/30* (2013.01); *H04R 9/06* (2013.01)

(58) Field of Classification Search
CPC ..... H04R 1/30; H04R 2201/34; H04R 1/345; H04R 1/403; H04R 1/2861; H04R 1/22; H04R 1/24; H04R 9/06; G10K 13/00
USPC ..... 381/340, 337, 106, 342, 345; 181/152, 181/159, 145, 177, 192
See application file for complete search history.

(56) References Cited

U.S. PATENT DOCUMENTS

2007/0147647 A1* 6/2007 Voishvillo ..... H04R 1/30 381/343
2011/0085692 A1* 4/2011 Voishvillo ..... H04R 1/30 381/343
2013/0182879 A1* 7/2013 Graber ..... H04R 1/345 381/343

(Continued)

*Primary Examiner* — Norman Yu
(74) *Attorney, Agent, or Firm* — Muncy, Geissler, Olds & Lowe, P.C.

(57) ABSTRACT

This application provides a combined-type phase plug, and a compression driver and a speaker using same. The combined-type phase plug of this application includes a first phase plug and a second phase plug. The first phase plug includes a cone, a plurality of fins, and a base ring. The plurality of fins is located on an outer surface of the cone. The base ring is located below the cone, and the plurality of fins extends downward to the base ring. The base ring is connected to the plurality of fins but is not connected to the cone. That is, the cone and the base ring are connected only by the plurality of fins. The second phase plug is located under the first phase plug. The second phase plug includes a tapered cone and a base. The tapered cone is located inside the base ring, and a first space is formed between the tapered cone and the base ring. A second space is formed between the tapered cone and the cone, and the second space extends to the first space. The base extends horizontally outward from the tapered cone, so that the base ring is located on the base. Multiple channels are formed by means of extensions of the first space and the second space to improve the acoustic performance.

10 Claims, 6 Drawing Sheets

(56) References Cited

U.S. PATENT DOCUMENTS

2018/0054671 A1* 2/2018 Voishvillo ..... H04R 9/066

* cited by examiner

COMBINED-TYPE PHASE PLUG, AND COMPRESSION DRIVER AND SPEAKER USING SAME

BACKGROUND

Technical Field

This application relates to a phase plug structure, and in particular, to a combined-type phase plug, and a compression driver and a speaker using same.

Related Art

In the field of speakers, a phase plug is often used to change a phase of a wave to improve the acoustic performance. The basic sound producing principle of a speaker is: A voice signal is input to a voice coil (voice coil) to generate a magnetic field. By means of attraction and repulsion between the voice coil and fixed magnetic poles, the voice coil generates a back-and-forth piston movement in a magnetic gap to make the vibrating diaphragm also generate vibration due to the back-and-forth piston movement of the voice coil, so as to cause air to resonate. Since an eardrum of a human ear is innervated by auditory nerves, a sound can be heard after the eardrum receives the vibration. However, sound waves are not directly scattered outward, and some of the sound waves may be sent to a listener's ears after being cross-reflected on the vibrating diaphragm. Therefore, a standing wave distortion is caused.

The phase plug located between the vibrating diaphragm and a throat can make sound waves from the vibrating diaphragm compound, as waves interfering with each other before the throat manifest sound waves of a similar interference direction, similar amplitude, and a similar phase, so as to improve the compression effect and eliminate phase interference at the same time, thereby obtaining a desirable linear effect.

Therefore, in the field of compression drivers and speakers, various phase plugs being capable of improving frequency response are designed without sparing any effort, and speakers producing sounds of different frequencies in particular need different phase plugs to change phases, so as to improve the acoustic performance.

SUMMARY

In view of this, this application provides a combined-type phase plug, a compression driver having the combined-type phase plug, and a speaker using same.

The combined-type phase plug of this application includes a first phase plug and a second phase plug. The first phase plug includes a cone, a plurality of fins, and a base ring. The plurality of fins is located on an outer surface of the cone. The base ring is located below the cone, and the plurality of fins extends downward to the base ring. The base ring is connected to the plurality of fins but is not connected to the cone. That is, the cone and the base ring are connected only by the plurality of fins. The second phase plug is located under the first phase plug. The second phase plug includes a tapered cone and a base. The tapered cone is located inside the base ring, and a first space is formed between the tapered cone and the base ring. A second space is formed between the tapered cone and the cone, and the second space extends to the first space. The base extends horizontally outward from the tapered cone, so that the base ring is located on top of the base. Multiple channels are formed by means of extensions of the first space and the second space to improve the acoustic performance.

In an embodiment, the cone includes a conical apex and a conical body, and the plurality of fins is located on the conical body.

In an embodiment, the first phase plug includes a base brim extending outward in a horizontal direction from the base ring, and the base brim corresponds to the base, so that the base brim is connected to the base in a fitting manner.

The compression driver of this application includes the combined-type phase plug described above, a housing, and an electromagnetic sound producing combination. The housing covers the first phase plug and the second phase plug. The housing includes an opening, and the first space formed between the tapered cone and the base ring extends to the opening. The electromagnetic sound producing combination is located under the second phase plug. The electromagnetic sound producing combination includes a vibrating diaphragm. The electromagnetic sound producing combination is capable of making, by means of an electromagnetic interaction, the vibrating diaphragm generate a piston movement to vibrate upward and downward. When the vibrating diaphragm vibrates upward and downward, the first space and the second space form an acoustic channel, so that a compound sound wave is output from the opening.

In an embodiment, the conical apex of the first phase plug is adjacent to the opening of the housing.

In an embodiment, the second phase plug includes a fixing portion extending partially around the base. The fixing portion is capable of being combined with the housing to fix the first phase plug between the second phase plug and the housing.

This application further provides a speaker, including: an exponential loudspeaker and the compression driver described above. The compression driver is coupled to the exponential loudspeaker. In an embodiment, the speaker is a horn loudspeaker (horn loudspeaker).

In conclusion, an acoustic channel formed by the combined-type phase plug according to this application can improve the compression effect and eliminate phase interference at the same time, thereby obtaining a desirable linear effect.

DETAILED DESCRIPTION

For convenience of reading, "up", "down", "left", and "right" specified in this specification according to the drawings are intended to specify a reference relative position between elements rather than limiting this application.

Figure 1:
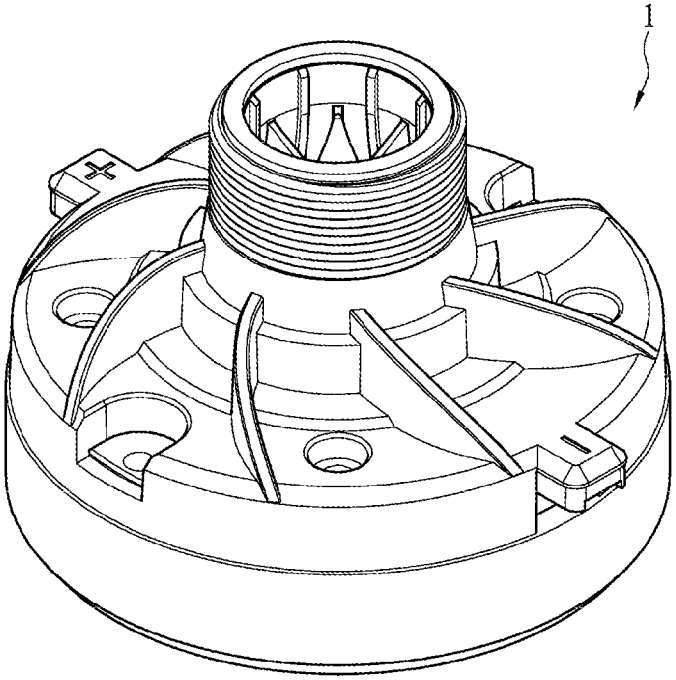
FIG. 1 is a schematic three-dimensional diagram of an embodiment of a compression driver according to this application.
Figure 2:
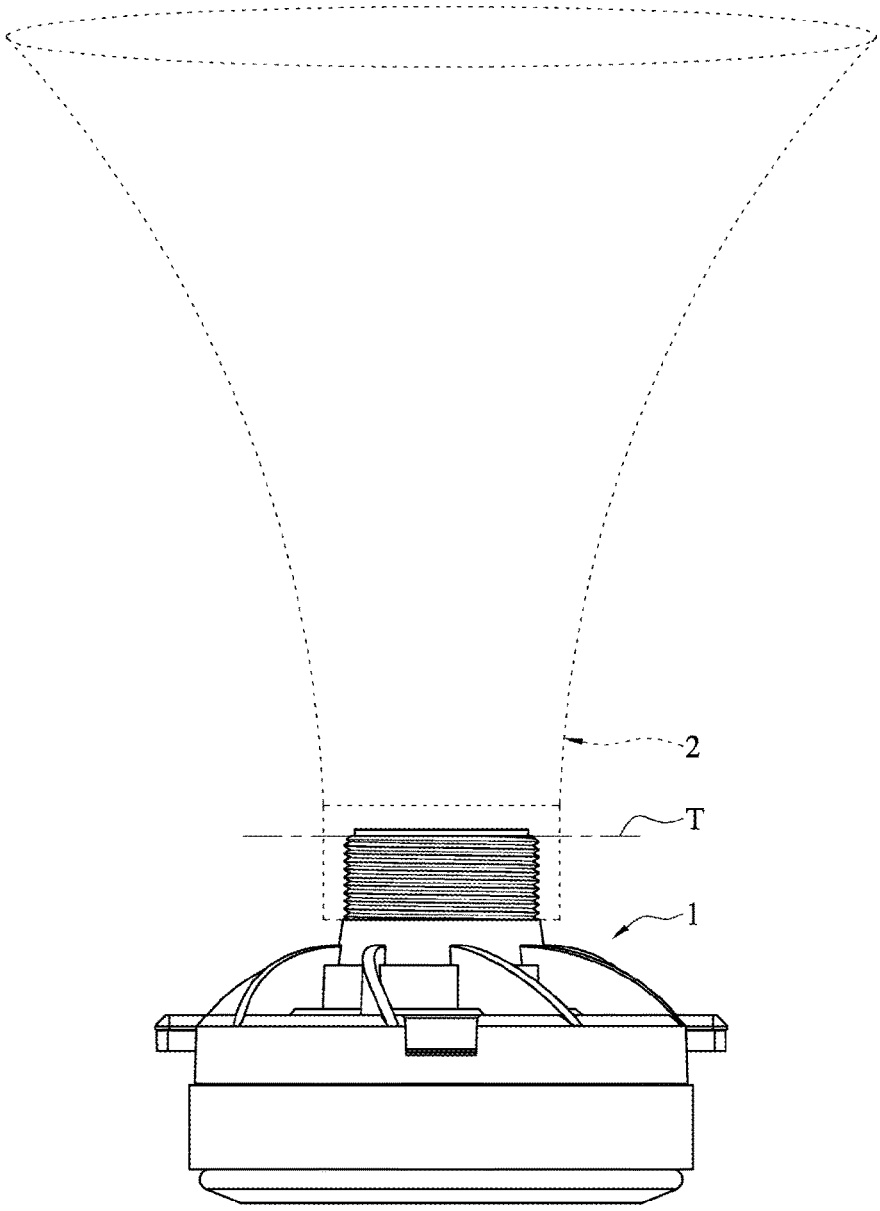
FIG. 2 is a schematic three-dimensional diagram of an embodiment of a speaker according to this application.

FIG. 1 is a schematic three-dimensional diagram of an appearance of a compression driver 1 having a combined-type phase plug according to this application. FIG. 2 is a schematic three-dimensional diagram of an appearance of a speaker with the compression driver 1 having a combined-type phase plug according to this application. The compression driver 1 is coupled to an exponential loudspeaker 2, and is mainly used to compress and conduct air (further description is provided in the following). The compression driver 1 conducts air to a listening environment by using a throat portion T and the exponential loudspeaker 2. In an embodiment, the speaker is a horn loudspeaker (horn loudspeaker).

Figure 3:
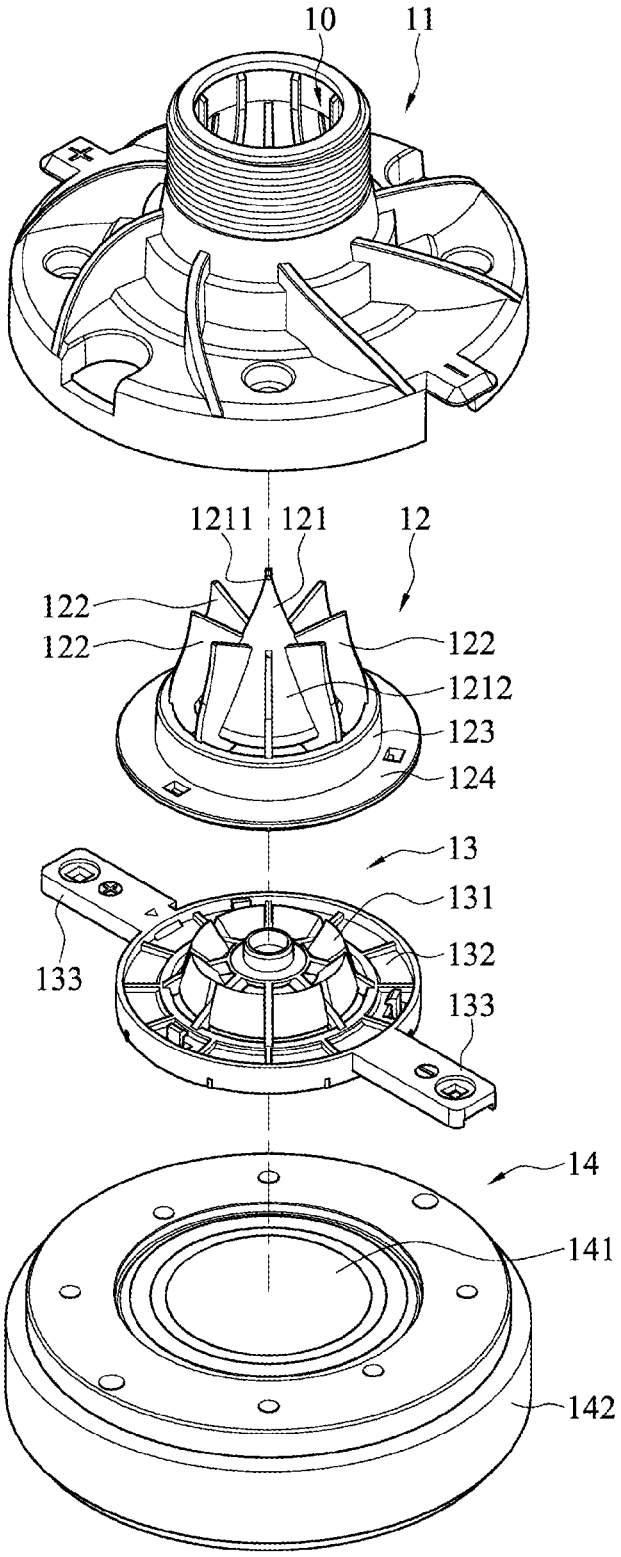
FIG. 3 is a schematic exploded three-dimensional diagram of FIG. 1.
Figure 4:
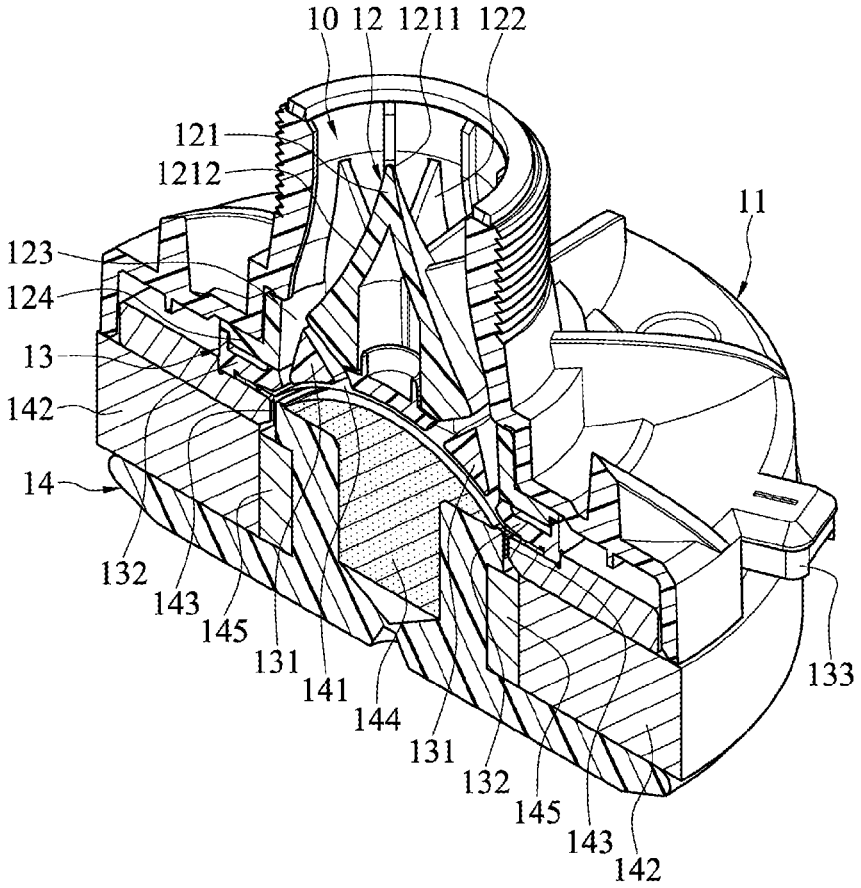
FIG. 4 is a schematic sectional view of FIG. 1.

Please refer to FIG. 3 and FIG. 4, in which the combined-type phase plug includes a first phase plug 12 and a second phase plug 13. The first phase plug 12 includes a cone 121, a plurality of fins 122, and a base ring 123. The base ring 123 is located below the cone 121. The fins 122 are located on an outer surface of the cone 121 and the fins 122 extend downward to the base ring 123. That is, the base ring 123 is connected to the fins 122 but is not connected to the cone 121. The cone 121 and the base ring 123 are connected only by the plurality of fins 122. The plurality of fins 122 of this application may strengthen the structure to further ensure the stability of the structure.

The second phase plug 13 is located under the first phase plug 12. The second phase plug 13 includes a tapered cone 131 and a base 132. As shown in FIG. 4, the tapered cone 131 is located inside the base ring 123 of the first phase plug 12, and a first space is formed between the tapered cone 131 and the base ring 123. A second space is formed between the tapered cone 131 and the cone 121, and the second space extends to the first space. The base 132 extends horizontally outward from the tapered cone 131, so that the base ring 123 of the first phase plug 12 is located on the base 132 of the second phase plug 13.

Further, the compression driver 1 of this application includes the first phase plug 12 and the second phase plug 13 (as described above), a housing 11, and an electromagnetic sound producing combination 14. The housing 11 covers the first phase plug 12 and the second phase plug 13. The housing 11 includes an opening 10 which may be defined as the throat portion T shown in FIG. 2. Please refer to FIG. 4 or FIG. 5, in which the first space formed between the tapered cone 131 of the second phase plug 13 and the base ring 123 of the first phase plug 12 extends to the opening 10. Multiple channels are formed by means of the first space and the second space and extensions thereof between the first phase plug 12 and the second phase plug 13. The plurality of fins 122 may further strengthen the structure of the channels, ensure the stability of the structure, and improve the acoustic performance.

Figure 5:
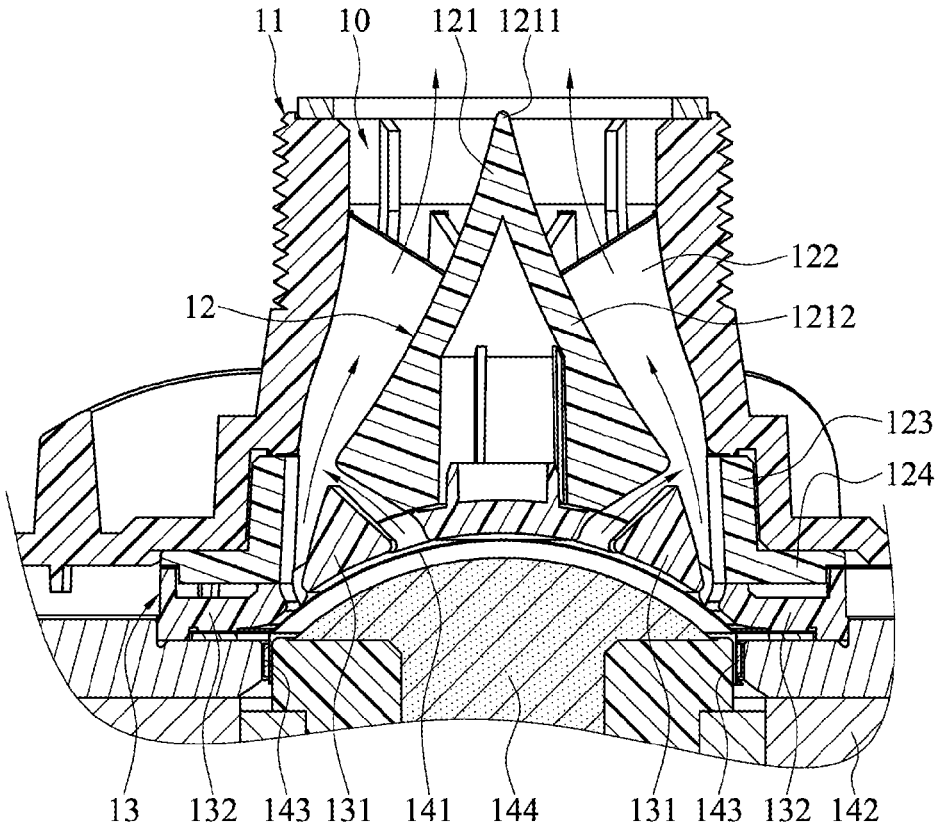
FIG. 5 is a partial schematic front view of FIG. 4.

In an embodiment, the cone 121 of the first phase plug 12 includes a conical apex 1211 and a conical body 1212. The fins 122 are located on the conical body 1212. The conical apex 1211 is adjacent to the opening 10 of the housing 11 (as shown in FIG. 5).

In an embodiment, the first phase plug 12 includes a base brim 124 extending outward in a horizontal direction from the base ring 123. The base brim 124 corresponds to the base 132 of the second phase plug 13, so that the base brim 124 is connected to the base 132 in a fitting manner.

In an embodiment, the second phase plug 13 includes a fixing portion 133 extending partially around the base 132. Although the fixing portions 133 shown in the figure are two long strip-shaped extension portions, the shape of the extension portions is not used for limiting this application. The fixing portion 133 is capable of being combined with the housing 11 to fix the first phase plug 12 between the second phase plug 13 and the housing 11.

Please refer to FIG. 3, in which the electromagnetic sound producing combination 14 is located under the second phase plug 13. The electromagnetic sound producing combination 14 includes a vibrating diaphragm 141. The electromagnetic sound producing combination 14 is capable of making, by means of an electromagnetic interaction, the vibrating diaphragm 141 generate a piston movement to vibrate upward and downward. In further detail, as shown in FIG. 4, the electromagnetic sound producing combination 14 further includes a magnet 142, a voice coil 143, and a yoke 145. An electric signal is applied to the voice coil 143 located between the magnet 142 and the yoke 145 to generate a magnetic field, and a piston movement is generated by means of interaction of attraction and repulsion between magnetic poles to make the vibrating diaphragm 141 vibrate upward and downward with the voice coil. In an embodiment, the electromagnetic sound producing combination 14 includes a sound-absorbing foam 144 to prevent a back cavity body from affecting the sound producing at the front.

As shown in FIG. 5, when the vibrating diaphragm 141 vibrates upward and downward, air between the vibrating diaphragm 141 and the phase plugs 12 and 13 is pressed. In this case, multiple channels are formed by means of the first space and the second space and extensions thereof, and the air is pressed to flow along an arrow direction. Compound sound waves are formed at the throat portion T at last and the sound waves are output from the opening 10.

Figure 6:
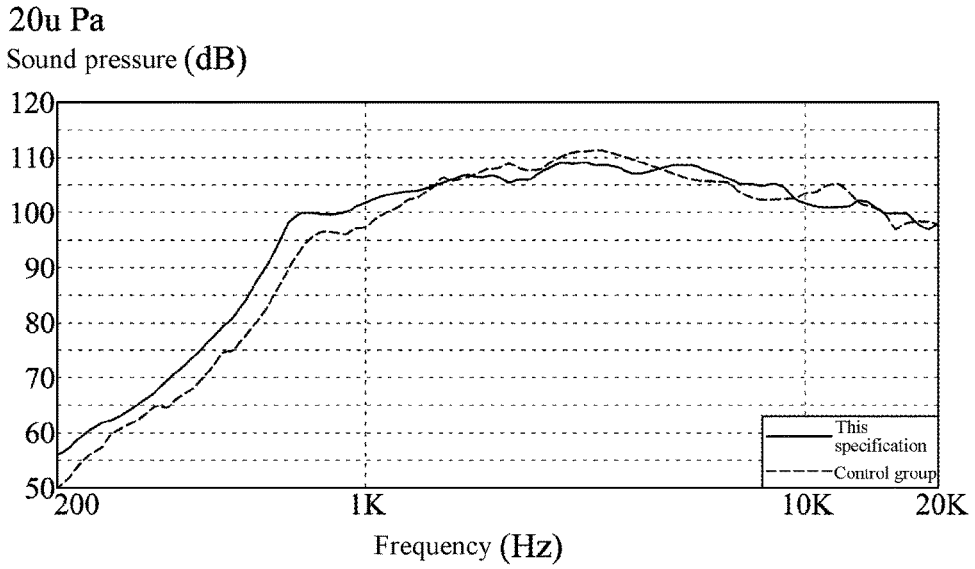
FIG. 6 is a schematic diagram of experimental data comparison of a compression driver according to this application.

Please refer to FIG. 6, a sound pressure experiment is performed by using the compression driver 1 according to this application. As shown in FIG. 6, compared with a control group having only one channel, this specification has a much better linear effect.

In conclusion, an acoustic channel formed by the combined-type phase plug according to this application can improve the compression effect and eliminate phase interference at the same time, thereby obtaining a desirable linear effect.

Although this application is disclosed as above by using the embodiments, the embodiments are not intended to limit this specification, and any person skilled in the art can make some variations and modifications without departing from the spirit and scope of this application. Therefore, the protection scope of this application should be subject to the scope defined by the appended claims.

What is claimed is:

1. A combined-type phase plug, comprising:

a first phase plug, comprising:

a cone;

a plurality of fins located on an outer surface of the cone; and a base ring located below the cone, wherein the plurality of fins extends downward to the base ring, and the base ring is connected to the plurality of fins but is not connected to the cone; and a second phase plug located under the first phase plug and comprising:

a tapered cone located inside the base ring, wherein a first space is formed between the tapered cone and the base ring; and a second space is formed between the tapered cone and the cone, and the second space extends to the first space; and a base extending horizontally outward from the tapered cone, wherein the base ring is located on the base.

2. The combined-type phase plug according to claim 1, wherein the cone comprises a conical apex and a conical body, and the plurality of fins is located on the conical body.

3. The combined-type phase plug according to claim 1, wherein the first phase plug comprises a base brim extending outward in a horizontal direction from the base ring, and the base brim corresponds to the base, so that the base brim is connected to the base in a fitting manner.

4. The combined-type phase plug according to claim 2, wherein the first phase plug comprises a base brim extending outward in a horizontal direction from the base ring, and the base brim corresponds to the base, so that the base brim is connected to the base in a fitting manner.

5. A compression driver, comprising:

a housing comprising an opening;

a first phase plug, comprising:

a cone;

a plurality of fins located on an outer surface of the cone; and a base ring located below the cone, wherein the plurality of fins extends downward to the base ring, and the base ring is connected to the plurality of fins but is not connected to the cone;

a second phase plug located under the first phase plug and comprising:

a tapered cone located inside the base ring, wherein a first space is formed between the tapered cone and the base ring, and the first space extends to the opening; and a second space is formed between the tapered cone and the cone, and the second space extends to the first space; and a base extending outward from the tapered cone, wherein the base ring is located on the base; and an electromagnetic sound producing combination located under the second phase plug, wherein the electromagnetic sound producing combination comprises a vibrating diaphragm, and the electromagnetic sound producing combination is capable of making, by means of an electromagnetic interaction, the vibrating diaphragm generate a piston movement to vibrate upward and downward, wherein the housing covers the first phase plug and the second phase plug, and when the vibrating diaphragm vibrates upward and downward, the first space and the second space form an acoustic channel, so that a compound sound wave is output from the opening.

6. The compression driver according to claim 5, wherein the cone comprises a conical apex and a conical body, the plurality of fins is located on the conical body, and the conical apex is adjacent to the opening.

7. The compression driver according to claim 5, wherein the first phase plug comprises a base brim extending outward in a horizontal direction from the base ring, and the base brim corresponds to the base, so that the base brim is connected to the base in a fitting manner.

8. The compression driver according to claim 6, wherein the first phase plug comprises a base brim extending outward in a horizontal direction from the base ring, and the base brim corresponds to the base, so that the base brim is connected to the base in a fitting manner.

9. The compression driver according to claim 6, wherein the second phase plug comprises a fixing portion extending partially around the base, and the fixing portion can be combined with the housing to fix the first phase plug between the second phase plug and the housing.

10. A speaker, comprising:

an exponential loudspeaker; and the compression driver according to claim 5 wherein the compression driver is coupled to the exponential loudspeaker.

* * * * *